US008025392B2

(12) United States Patent
Yamamoto

(10) Patent No.: US 8,025,392 B2
(45) Date of Patent: Sep. 27, 2011

(54) RECORDING APPARATUS HAVING A MOVABLE BLOCKING PLATE FOR TRAPPING FOREIGN SUBSTANCES

(75) Inventor: Shinya Yamamoto, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 12/362,856

(22) Filed: Jan. 30, 2009

(65) Prior Publication Data

US 2009/0200735 A1 Aug. 13, 2009

(30) Foreign Application Priority Data

Feb. 7, 2008 (JP) ..... 2008-027593

(51) Int. Cl.
*B41J 2/01* (2006.01)
*G03G 21/12* (2006.01)

(52) U.S. Cl. ..... 347/104; 399/98; 399/123

(58) Field of Classification Search ..... 347/104, 347/36, 34; 399/98, 99, 123, 124
See application file for complete search history.

(56) References Cited

U.S. PATENT DOCUMENTS

| | | | | |
|---|---|---|---|---|
| 6,916,132 | B2 * | 7/2005 | Otsuka et al. | 400/621 |
| 7,021,738 | B2 * | 4/2006 | Juan et al. | 347/19 |
| 2002/0098009 | A1 | 7/2002 | Nakamura et al. | |
| 2002/0122097 | A1 * | 9/2002 | Beerling et al. | 347/50 |
| 2005/0212883 | A1 | 9/2005 | Okamoto | |
| 2006/0210306 | A1 * | 9/2006 | Okamoto | 399/119 |
| 2006/0216056 | A1 * | 9/2006 | Okabe | 399/101 |
| 2008/0159760 | A1 * | 7/2008 | Okano et al. | 399/35 |
| 2008/0165239 | A1 * | 7/2008 | Hiroki et al. | 347/104 |
| 2008/0239050 | A1 * | 10/2008 | Chikamoto | 347/104 |
| 2008/0239053 | A1 * | 10/2008 | Sakano | 347/104 |
| 2009/0141111 | A1 * | 6/2009 | Yamamoto | 347/104 |
| 2009/0189966 | A1 * | 7/2009 | Sugimoto et al. | 347/104 |
| 2010/0110118 | A1 * | 5/2010 | Sano | 347/7 |

FOREIGN PATENT DOCUMENTS

| | | | |
|---|---|---|---|
| JP | 01321220 | A * | 12/1989 |
| JP | 04045474 | A * | 2/1992 |
| JP | 2001-130771 | | 5/2001 |
| JP | 2001-305933 | | 11/2001 |
| JP | 2002-214874 | | 7/2002 |
| JP | 2005-271278 | A | 10/2005 |

OTHER PUBLICATIONS

Notice of Reasons for Rejection for Japanese Patent Application 2008-027593 mailed on Apr. 27, 2010.

* cited by examiner

*Primary Examiner* — Shelby Fidler
(74) *Attorney, Agent, or Firm* — Banner & Witcoff, Ltd.

(57) ABSTRACT

A recording apparatus with a conveying mechanism and a blocking member are described. The blocking member reduces foreign substances from soiling a unit or member located adjacent to or below the conveying mechanism. The conveying mechanism may be moved to a position permitting access to remove paper jams while the blocking member is located to permit the conveying mechanism to move to the position while continuing to reduce foreign substances from soiling the unit or member.

18 Claims, 6 Drawing Sheets

RECORDING APPARATUS HAVING A MOVABLE BLOCKING PLATE FOR TRAPPING FOREIGN SUBSTANCES

CROSS REFERENCE TO RELATED APPLICATIONS

This application claims priority from Japanese Patent Application No. 2008-27593 filed on Feb. 7, 2008, the entire subject matter of which is incorporated herein by reference.

BACKGROUND

1. Technical Field

The present invention relates to a recording apparatus that records an image on a recording medium.

2. Description of Related Art

A conventional inkjet recording apparatus ejects ink to record an image onto a recording medium, e.g., a sheet of paper. When a sheet jam occurs in this inkjet recording apparatus, a jammed sheet is removed by shifting a sheet conveying mechanism (including a belt) away from a recording head.

The above-mentioned inkjet recording apparatus includes, in a housing thereof, a recording head, a sheet conveying mechanism, and a sheet cassette disposed in this order from the top. If foreign substances, e.g., ink and/or sheet powder, on a belt of the sheet conveying mechanism drop from the belt, the sheet cassette becomes soiled with the foreign substances. In order to prevent the soiling of the sheet cassette and other components, a plate may be provided directly below the sheet conveying mechanism to block the foreign substances. Such blocking plate, however, might interfere with the sheet conveying mechanism, if the sheet conveying mechanism is shifted down for removal of a jammed sheet.

SUMMARY

It may be beneficial for a recording apparatus to include a member for blocking foreign substances falling from a recording medium conveying mechanism from soiling a unit disposed below the recording medium conveying mechanism and in which the recording medium conveying mechanism is shifted without interference from the blocking member.

The member may include one or more plates. The member may optionally include one or more elements to trap the foreign substances. The member may be movable with the conveying mechanism or may be movable apart from the conveying mechanism.

Other objects, features, and advantages will be apparent to persons of ordinary skill in the art from the following detailed description of the invention and the accompanying drawings.

BRIEF DESCRIPTION OF THE DRAWINGS

For a more complete understanding of the present invention, and the needs satisfied thereby, reference is now made to the following descriptions taken in connection with the accompanying drawings.

DETAILED DESCRIPTION

One or more aspects described herein relate to an image recording apparatus with a blocking member where the blocking member may be shifted to allow for access inside the image recording apparatus.

It is noted that various connections are set forth between elements in the following description. It is noted that these connections in general and, unless specified otherwise, may be direct or indirect and that this specification is not intended to be limiting in this respect.

Embodiments of the present invention may be understood by referring to FIGS. 1-6B, like numerals being used for like corresponding parts in the various drawings.

Figure 1:
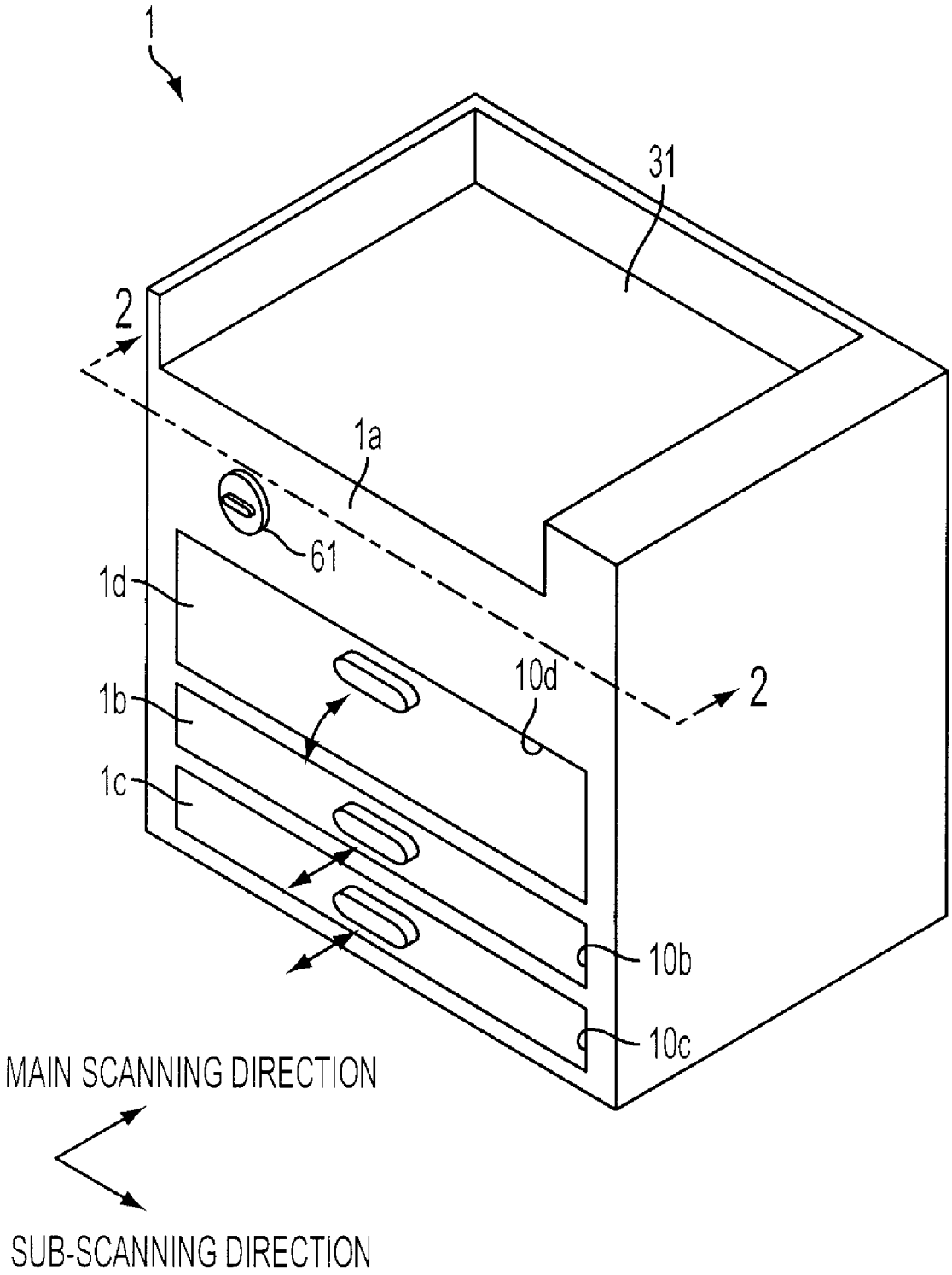
FIG. 1 is a perspective view of an inkjet printer according to an embodiment of the invention.

As shown in FIG. 1, an inkjet printer 1 includes a rectangular parallelepiped housing 1*a*. The housing 1*a* includes, at the front thereof, a rotary member 1*a* that is rotated by the user, a door 1*d* fitted into an opening 10*d* so as to be opened and closed about a horizontal shaft, and a sheet feed unit 1*b* and an ink tank unit 1*c* inserted, respectively, through openings 10*b*, 10*c*. An output portion 31 is disposed at the top of the housing 1*a*. The door 1*d* is opposed to a conveying mechanism 21 in a main scanning direction.

Figure 2:
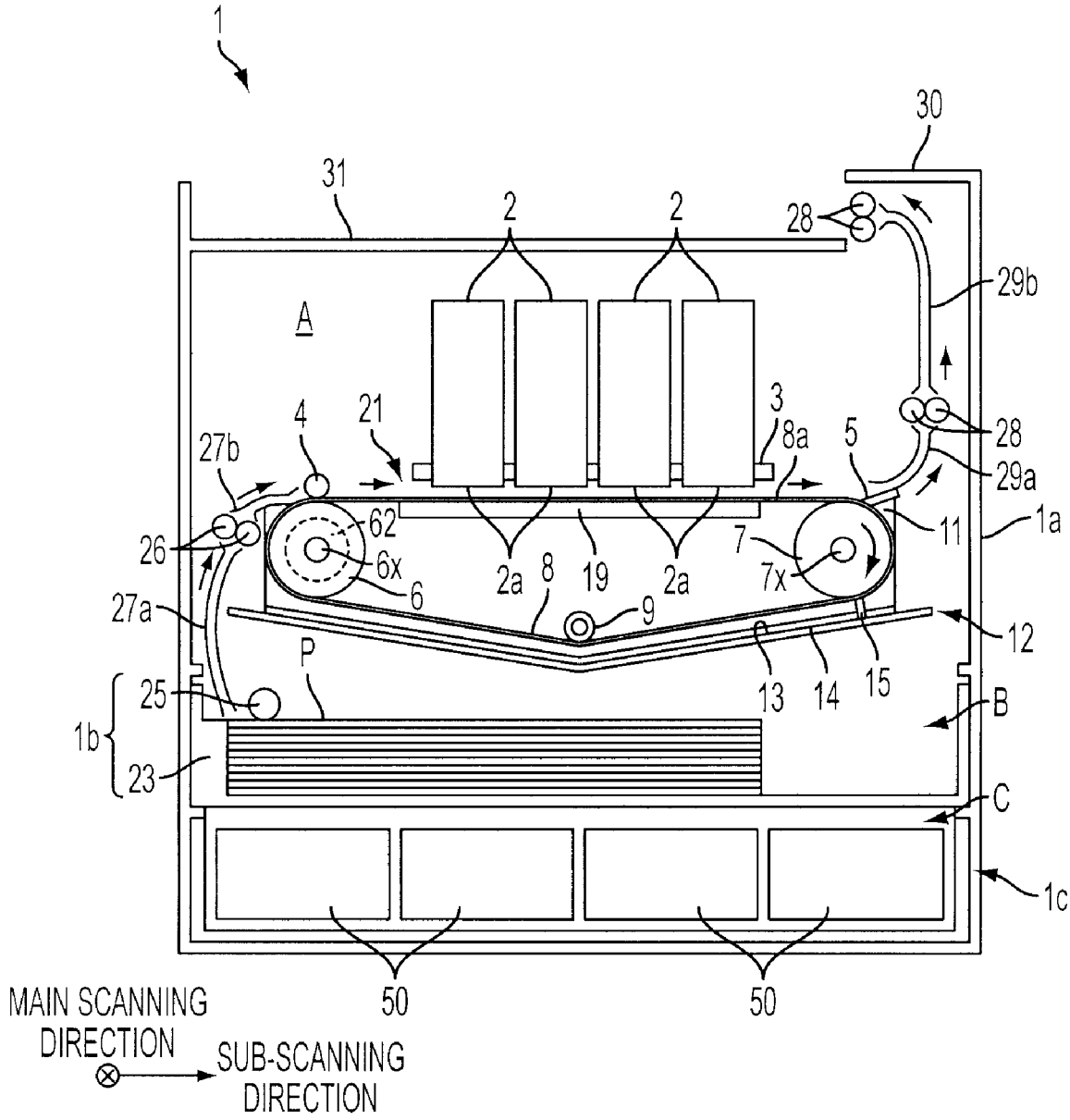
FIG. 2 is a vertical cross-sectional view of the inkjet printer taken along line 2-2 of FIG. 1.

Referring now to FIG. 2, an internal structure of the inkjet printer 1 will be described. The inside of the housing 1*a* is divided into three spaces A, B, and C in this order from the top. Four inkjet heads 2 (which may be configured to eject magenta, cyan, yellow, and black inks, respectively) and a conveying mechanism 2 are disposed in the space A. It is appreciated that other colors may be used in various orders as desired. The sheet feed unit 1*b* and the ink tank unit 1*c* are disposed in the spaces B and C, respectively, when the sheet feed unit 1*b* and the ink tank unit 1*c* are attached to the housing 1*a*. The spaces B and C relate to the openings 10*b* and 10*c*, respectively. The sheet feed unit 1*b* and the ink tank unit 1*c* are configured to be attached to and detached from the housing 1*a* in the main scanning direction, e.g., a direction orthogonal to the drawing sheet of FIG. 2. In this embodiment, the main scanning direction is a direction orthogonal to a conveying direction of a sheet P by the conveying mechanism 21, and a sub-scanning direction is a direction parallel to the sheet conveying direction and orthogonal to the main scanning direction.

The sheet P is conveyed from the sheet feed unit 1*b* toward the output portion 31 in a direction shown by boldface arrows in FIG. 2 along a sheet conveying path defined inside the inkjet printer 1. The sheet feed unit 1*b* includes a sheet tray 23 for storing therein a plurality of sheets P and a feed roller 25 attached to the sheet tray 23. The feed roller 25 is configured to feed an uppermost one of the sheets P stacked in the sheet tray 23. The uppermost sheet P fed by the feed roller 25 is fed to the conveying mechanism 21 while being nipped by a pair of rollers 26 and being guided by guides 27*a*, 27*b*.

As shown in FIGS. 2 and 3, the conveying mechanism 21 may include two belt rollers 6, 7, a member for supporting the sheet P, e.g., an endless conveying belt 8 wound around the belt rollers 6, 7, a tension roller 9, and a pair of frames 11 for rotatably supporting the belt rollers 6, 7 and the tension roller 9. The tension roller 9 contacts an inner circumference of a lower portion of a loop of the conveying belt 8 and is urged downward to apply a tension to the conveying belt 8. The belt roller 7 is a driving roller that rotates clockwise in FIG. 2 when a shaft 7*x* thereof is driven by a conveying motor (not shown). The belt roller 6 is a driven roller that is rotated clockwise in FIG. 2 when the conveying belt 8 moves by the rotation of the belt roller 7. It is appreciated that other conveying mechanisms are available and may vary in the location and number of rollers and number of belts. Further, blocking plate 12 is shown angled about tension roller 9. It is appreciated that tension roller 9 may be moved and the shape of blocking plate 12 may be modified to comport with the change in location of tension roller 9.

An outer circumferential surface 8*a* of the conveying belt 8 is opposed to the inkjet heads 2 at an upper portion of the loop of the conveying belt 8. The outer circumferential surface is treated with silicone to be tacky. This allows the sheet P to make a flat and close contact with the outer circumferential surface 8*a* of the belt. A nip roller 4 is disposed on the sheet conveying path at a position that opposes the belt roller 6 via the conveying belt 8. The nip roller 4 presses the sheet P fed by the sheet feed unit 1*b* against the outer circumferential surface 8*a* of the conveying belt 8. Then the sheet P is conveyed rightward in FIG. 2 in the sheet conveying direction while being held on the outer circumferential surface 8*a* by the tackiness thereof.

Figure 3A:
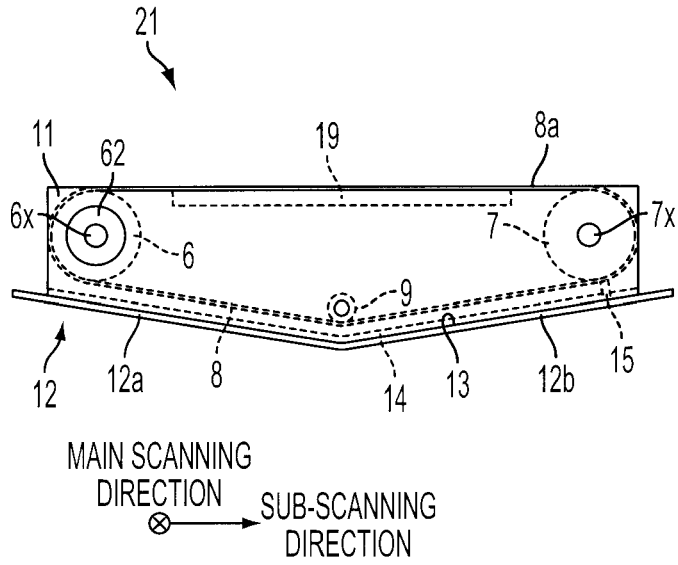
FIG. 3A is a side view of a conveying mechanism of the inkjet printer of FIG. 2.
Figure 3B:
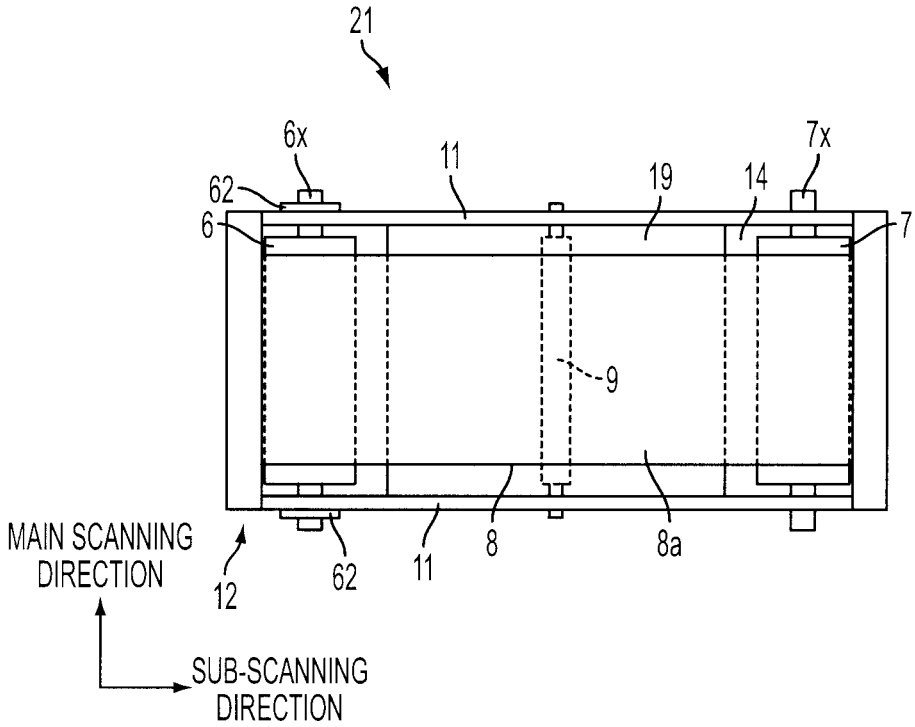
FIG. 3B is a plan view of the conveying mechanism.

As shown in FIGS. 3A and 3B, each of the pair of frames 11 is formed by a plate member having a generally rectangular shape, and the pair of frames 11 is disposed to sandwich the belt rollers 6, 7 in the main scanning direction. A central portion of a lower end of each of the pair of frames 11 projects downward so as to conform to the lower portion of the loop of the conveying belt 8 that is inclined from the belt rollers 6, 7 toward the tension roller 9. A blocking plate 12 is attached to lower surfaces of the pair of support frames 11. The blocking plate 12 may be made of metal, e.g. stainless steel. In addition to metal, the blocking plate 12 may also be made of plastic, rubber, fiberglass, and related materials and any combination thereof The outer circumferential surface 8*a* of the conveying belt 8 is opposed to the blocking plate 12 at a lower portion of the loop of the conveying belt 8.

As shown in FIG. 3B, the blocking plate 12 is disposed below the conveying mechanism 21 so as to vertically overlap the entire area of the conveying belt 8. A first area that is defined by projecting the blocking plate 12 vertically onto an imaginary horizontal surface includes the entirety of a second area that is defined by projecting the conveying belt 8 vertically onto the imaginary horizontal surface. In other words, when the conveying mechanism 21 is viewed from the top, an area enclosed by an outline of the conveying belt 8 falls within an area enclosed by an outline of the blocking plate 12.

The blocking plate 12 has a V-shaped cross-section that conforms to lower ends of the pair of support frames 11. In an alternative embodiment, the blocking plate 12 may have a different cross section including U-shaped or other concave cross sections. In further embodiments, the blocking plate 12 may have cross sections that are convex.

In the first embodiment, as shown in FIG. 3A, the blocking plate 12 has two inclined portions 12*a*, 12*b* that are inclined from the right and left ends thereof to the central portion thereof The blocking plate 12 vertically overlaps the conveying belt 8 in the sub-scanning direction (in a right/left direction in FIGS. 2, 3A, and 3B) and extends beyond the conveying belt 8 in the sub-scanning direction to positions adjacent to side walls of the housing la that are opposed to each other in the sub-scanning direction. In other words, the blocking plate 12 extends in the sub-scanning direction such that the outer ends of the inclined portions 12*a*, 12*b* do not vertically oppose the conveying belt 8. This design allows the blocking plate 12 to reliably receive foreign substances falling from the conveying belt 8. The blocking plate 12, which is attached to the lower surfaces of the frames 11, moves together as the conveying mechanism 21 pivots about the shaft 7*x*, as will be described later. In this case, the blocking plate 12 is designed to have such a length and such a shape that the left end of the blocking plate 12 in FIG. 2 will not contact the guide 27*a*.

In alternative embodiments, the blocking plate 12 may be composed of two or more plates joined together and/or other structures that prevent foreign substances from accumulating on the sheet tray 23.

Also, as shown in FIG. 3B, the blocking plate 12 is vertically overlapped by the conveying belt 8 in the main scanning direction and extends beyond the conveying belt 8 in the main scanning direction to positions that oppose the lower surfaces of the frames 11. This design allows the blocking plate 12 to reliably receive foreign substances falling from the conveying belt 8. Alternatively, the blocking plate 12 may extend in the main scanning direction to positions adjacent to the side walls of the housing 1*a* that are opposed to each other in the main scanning direction. This design allows the blocking plate 12 to more reliably receive foreign substances falling from the conveying belt 8.

In yet further embodiments, the blocking plate 12 may only extend as far as the end of the sheets in sheet tray 23. This minimizes the overall length of the blocking plate 12. By minimizing the length of the blocking plate 12, other structures may be placed in housing 1*a* without interference from blocking plate 12 when shifting positions as shown in, for instance, FIGS. 4A and 4B.

In an additional embodiment, a trapping member, e.g., an absorbing member 14, for trapping or absorbing ink dropping from the conveying belt 8 may optionally be disposed on an upper surface 13 of the blocking plate 12. The absorbing member 14 may be made of a porous material, e.g. a sponge, and covers the entire area of the upper surface 13 sandwiched between the pair of frames 11. This allows the absorbing member 14 to quickly absorb the ink dropping from the conveying belt 8, thereby preventing the ink from being splashed by the blocking plate 12 and adhering back to the conveying mechanism 21. In addition, the ink is less likely to drop from the absorbing member 14 of the blocking plate 12 even when the conveying mechanism 21 and the blocking plate 12 are shifted as will be described later. Alternatively, absorbing member 14 may be provided in various positions on upper surface 13. For instance, absorbing member 14 may only be provided on side 12*a* or side 12*b* of blocking plate 12. In yet another alternative example, absorbing member may only be provided along the periphery of blocking plate 12.

Additionally, additional trapping members may be used. For example, where the blocking plate 12 directs ink to one side or another when shifting between the positions of FIGS. 4A and 4B, the absorbing member 14 disposed along the periphery of blocking plate 12 absorbs any liquid ink when in the position of FIG. 4B but permits the ink to dry on upper surface 13 of blocking plate 12.

When the absorbing member 14 absorbs the ink dropping from the conveying belt 8 and becomes wet, sheet powder (also referred to as sheet dust or paper dust) falling from the conveying belt 8 is likely to adhere to the surface of the absorbing member 14. This prevents the sheet powder fallen from the conveying belt 8 and adhered to the absorbing member 14 from floating via an air current produced as the conveying belt 8 moves. Accordingly, the sheet powder is prevented from adhering to parts of the conveying mechanism 21. In addition, the sheet powder is less likely to fall from the absorbing member 14 of the blocking plate 12 even when the conveying mechanism 21 and the blocking plate 12 are shifted.

Alternatively, the absorbing member 14 may be made of an adhesive material that traps foreign substances other than liquid, e.g., sheet powder, by physical contact with the foreign substances. In this case, also, the absorbing member 14 prevents the sheet powder having fallen onto the blocking plate 12 from adhering to the conveying mechanism 21, similarly to when the absorbing member 14 formed by a porous material becomes wet. In addition, the sheet powder is less likely to fall from the absorbing member 14 of the blocking plate 12 even when the conveying mechanism 21 and the blocking plate 12 are shifted. The absorbing member 14, which has an adhesive property regardless when the absorbing member 14 is wet or dry, is allowed to constantly achieve both of the above-described benefits.

A member for removing foreign substances from the outer circumferential surface 8*a* of the conveying belt 8, e.g., a blade 15, may be disposed on the upper surface 13 of the blocking plate 12 at a position that opposes the belt roller 7 via the conveying belt 8. As shown in FIG. 3A, the blade 15 can be disposed upright on the upper surface 13 such that an upper end of the blade contacts the outer circumferential surface 8*a*. The blade 15 has the same length, in the main scanning direction, as the width of the conveying belt 8. The blade 15 removes foreign substances from the outer circumferential surface 8*a*, and the removed foreign substances fall onto the blocking plate 8. As a result, the blocking plate 12 receives the foreign substances.

The driven belt roller 6 is configured to move downward toward the space B, as will be described in detail later. The sheet feed unit 1*b* is accommodated in the space B. The conveying mechanism 21 and the blocking plate 12 are partially disposed in the space B when they are shifted down.

A separating plate 5 is disposed on the sheet conveying path at a position that opposes the belt roller 7 via the conveying belt 8. The separating plate 5 separates the sheet P being conveyed by the conveying belt 8 from the outer circumferential surface 8*a* of the conveying belt 8. The separated sheet P is conveyed while being pinched by two pairs of conveying rollers 28 and is discharged from an opening 30 formed at the top of the housing 1*a* toward the output portion 31.

The four inkjet heads 2 extend in the main scanning direction and are arranged side by side in the sub-scanning direction. The inkjet heads 2 are supported via a frame 3 by the housing 1*a*. The inkjet printer 1 is of a line-type inkjet printer. An ink ejecting surface 2*a* is formed on a lower surface of each of the inkjet heads 2 and has a plurality of ink ejecting nozzles (not shown) arranged in the main scanning direction.

A platen 19 having a substantially rectangular parallelepiped shape is disposed inside the loop of the conveying belt 8 so as to oppose the inkjet heads 2. Ends of the platen 19 that are opposed in the main scanning direction are fixed to the frames 11. The platen 19 supports the conveying belt 8 from an inner circumferential side of the conveying belt 18 while an upper surface of the platen 19 contacts an inner circumferential surface of an upper portion of the conveying belt 8. The outer circumferential surface 8*a* of the upper portion of the conveying belt 8 opposes the lower surfaces of the inkjet heads 2, i.e., the ink ejecting surfaces 2*a* in parallel with each other, while leaving a small gap therebetween. This gap forms a part of the sheet conveying path. When the sheet P passes right below the inkjet heads 2 sequentially while being held on the outer circumferential surface 8*a* of the conveying belt 8, color inks are ejected from the inkjet heads 2 onto an upper surface of the sheet P to form a desired color image thereon.

The inkjet heads 2 are respectively connected to ink tanks 50 in the ink tank unit 1*c* disposed in the space C. Each of the ink tanks 50 stores ink of a color for a corresponding one of the inkjet heads 2, and the ink is supplied via a tube (not shown) or the like to the corresponding inkjet head 2. The ink tanks 50 are replaced with new ones by detaching and attaching the ink tank unit 1*c*.

Figure 4A:
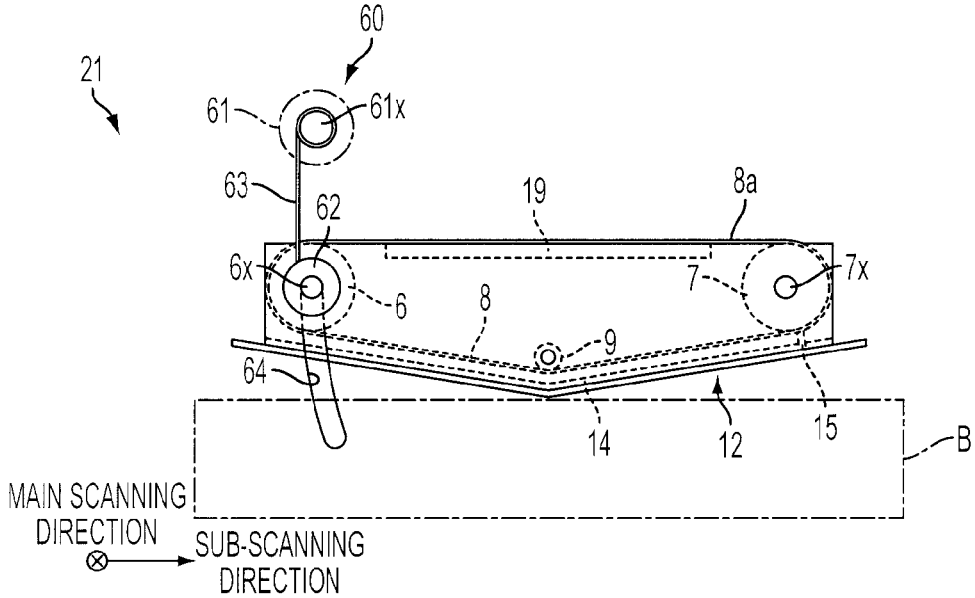
FIGS. 4A and 4B are illustrative diagrams showing movement of a belt roller of the conveying mechanism.
Figure 4B:
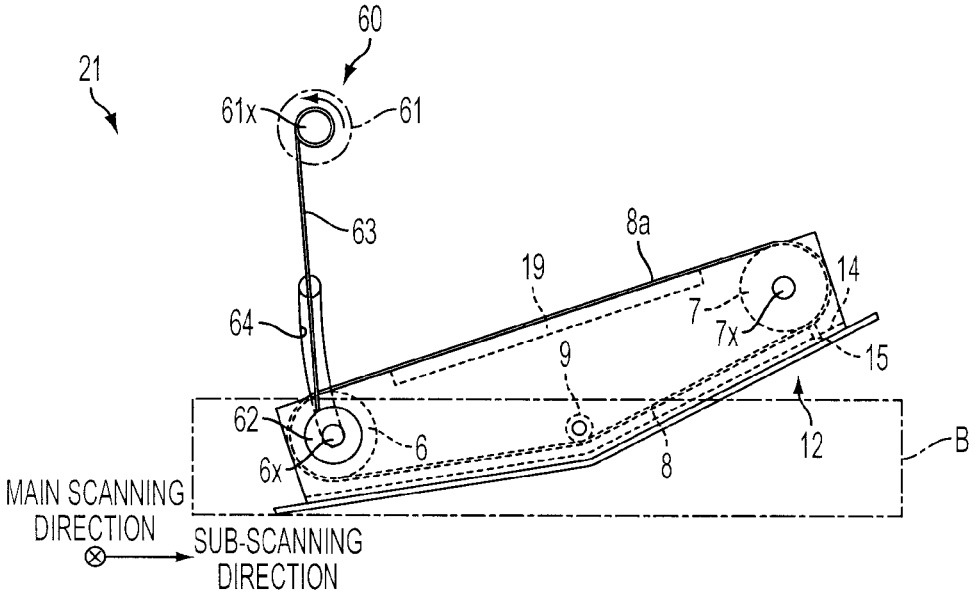

Referring now to FIGS. 4A and 4B, a shift of the conveying mechanism 21, i.e., a shift of the belt roller 6 will be described.

The printer 1 includes a roller shifting mechanism 60 that shifts the belt roller 6. The roller shifting mechanism 60 includes the rotary member 61, a pair of rings 62, a pair of link members 63, and a pair of slits 64. Each of the rings 62 is disposed adjacent to a corresponding one of both ends of a shaft 6*x* of the belt roller 6 to rotatably support the shaft 6*x*. Each of the slits 64 is formed in a main body of the printer at a position that opposes a corresponding one of the both ends of the shaft 6*x*. The both ends of the shaft 6*x* are disposed movably in the slits 64. Each of the slits 64 is a narrow elongate hole having an upper end and a lower end and an arcuate shape formed about the shaft 7*x* of the belt roller 7 as a center. The upper end corresponds to a position of the shaft 6*x* that is in a normal printing position. The lower end corresponds to a position of the shaft 6*x* that is in the space B.

Each of the link members 63 is a wire, for example. One end of the link member 63 is fixed to an upper end of the corresponding ring 62, the other end of the link member 63 is fixed to a shaft 61*x* of the rotary member 61, and the wire is wound around the shaft 61*x*. When the conveying mechanism 21 is located in the normal printing position as shown in FIG. 4A, a necessary load is applied, by a gear, a clutch spring or the like, to the shaft 61*x* of the rotary member 61 in a clockwise direction such that the link member 63 will not be wound back and released.

In order to remove a jammed sheet P, the user pulls out the sheet feed unit 1*b* from the housing 1*a* toward a front side of the housing 1*a* in the main scanning direction. When the sheet feed unit 1*b* is detached from the housing la, the space B becomes open and accessible.

Because the link member 63, the ring 62, and the slit 64 functions in the same manner on either side of the shaft 6*x*, the following description is made only for one side of the shaft 6*x*. When the user rotates the rotary member 61 counterclockwise in FIG. 4A when the space B is open, the link member 63 is wound back and released from the shaft 61*x*. Consequently, the shaft 6*x* moves together with the ring 62 in an inclined right downward direction along the slit 64 and stops at the lower end of the slit 64. As the shaft 6*x* moves as describe above, the belt roller 6 moves in the inclined right downward direction along an arc formed about the shaft 7*x* as a center, and a part of the conveying mechanism 21 and a part of the blocking plate 12 are shifted into the space B. When the shaft 6*x* is at the lower end of the slit 64, the conveying mechanism 21 and the blocking plate 12 extends in the spaces A and B in an inclined manner with the left end of the conveying mechanism 21 down in FIG. 4B. In this case, ink and other foreign substances will not drop downward from the blocking plate 12 because the absorbing member 14 is disposed on the blocking member 12. Also, a necessary load is applied, by a gear, a clutch spring or the like, to the shaft 61*x* of the rotary member 61 in a clockwise direction such that the moving speed of the shaft 61*x* will not become excessively high.

A gap between the conveying belt 8 and the inkjet heads 2 becomes large when the belt roller 6 is shifted from the position shown in FIG. 4A to the position shown in FIG. 4B. In this state, the user is allowed, by pulling the door 1*d* at the front of the housing 1*a* toward a front side, to check for any sheet P jammed between the upper portion of the loop of the conveying belt 8 and the inkjet heads 2 and remove the jammed sheet P from the housing 1*a*.

After removing the jammed sheet P, the user closes the door id and rotates the rotary member 61 clockwise in FIG. 4B. Consequently, the link member 63 is wound around the shaft 61*x*, and the shaft 6*x* moves in an inclined left upward direction along the slit and stops at the upper end of the slit 64, as shown in FIG. 4A. As the shaft 6*x* moves as described above, the belt roller 6 moves in the inclined left upward direction along an arc formed about the shaft 7*x* of the belt roller 7, and returns to the original position shown in FIG. 4A for normal printing. At this time, the conveying mechanism 21 and the blocking plate 12 return to the original positions. Then the user attaches the sheet feed unit 1*b* back to the housing 1*a* such that the sheet feed unit 1*b* is disposed in the space B. The printer 1 becomes ready for printing. When the printer 1 receives a print start command from a personal computer or the like, the printer 1 starts printing by feeding the uppermost sheet P from the sheet feed unit 1*b*.

Although, in this embodiment, the sheet feed unit 1*b* is detached from the housing 1*a* before shifting the conveying mechanism 21 in order to remove the jammed sheet P, it is not necessary to do so if an open space enough for shifting the conveying mechanism 21 is formed in the space B only by pulling the sheet feed unit 1*b* outward. A rear end of the sheet feed unit 1*b* may be located inside the housing 1*a* unless the rear end will interfere with the conveying mechanism 21 to be shifted.

Although, in this embodiment, the sheet feed unit 1*b* is pulled out from the housing 1*a* in the main scanning direction, the sheet feed unit 1*b* may be configured to be pulled out in the sub-scanning direction. In this case, an open space for shifting the conveying mechanism 21 and the blocking plate 12 is formed in the space B by pulling the sheet feed unit 1*b* to a position where a left end of the sheet feed unit 1*b* vertically opposes the belt roller 7 in FIG. 2.

As describe above, the blocking plate 12 is disposed blow the conveying mechanism 21 so as to vertically overlap the entire area of the conveying belt 8. Accordingly, if foreign substances fall from the conveying belt 8, the foreign substances are received by the blocking plate 12. This prevents the sheet feed unit 1*b* disposed in the space C and the sheets P stored in the sheet feed unit 1*b* from being soiled with the foreign substances. In addition, because the blocking plate 12 is attached to the conveying mechanism 21, the blocking plate 21 is shifted as the conveying mechanism 21 is shifted. Accordingly, the blocking plate 21 will not interfere with the conveying mechanism 21 when the conveying mechanism 21 is shifted.

In addition, an open space is formed in the space C by detaching the sheet feed unit 1*b* from the housing 1*a*, thereby allowing a part of the conveying mechanism 21 and a part of the blocking plate 12 to move down into the open space. Accordingly, there is no need to provide an open space exclusively for shifting the conveying mechanism 21 and the blocking plate 12. As a result, the inkjet printer 1 is downsized in the height direction.

Figure 5A:
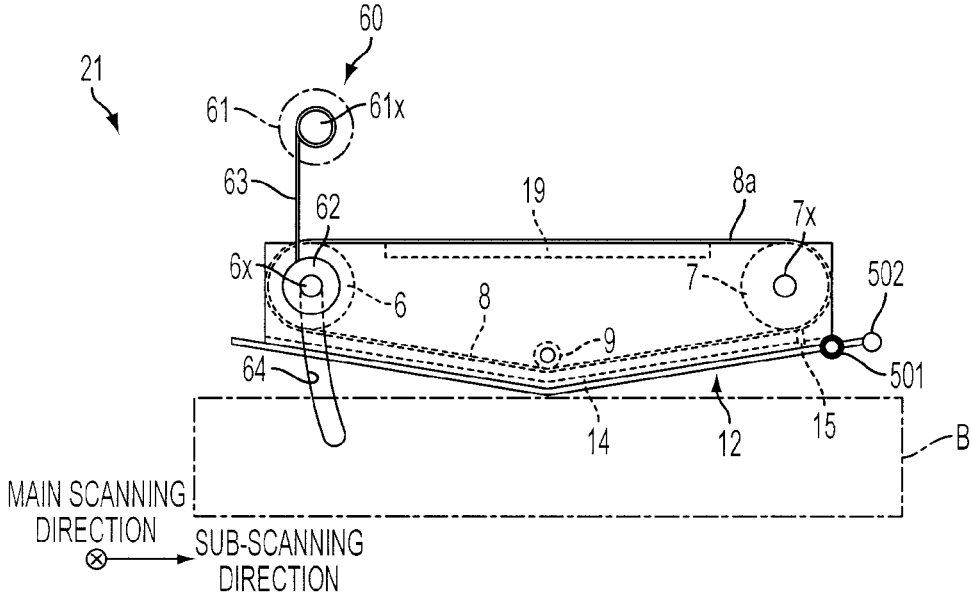
FIGS. 5A and 5B are illustrative diagrams showing movement of a blocking plate in another embodiment.
Figure 5B:
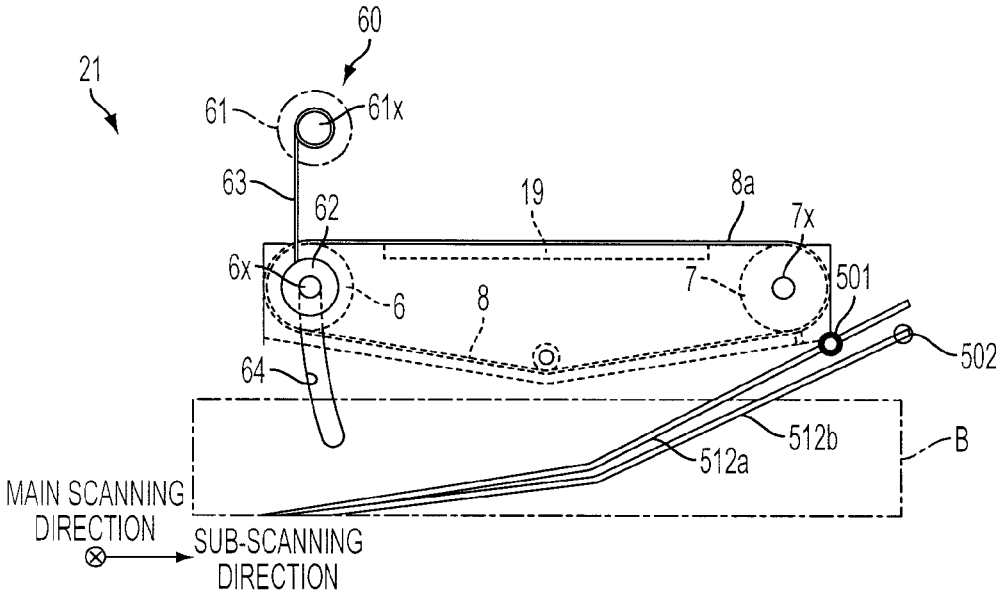

FIGS. 5A and 5B show another embodiment where blocking plate 12 may be separately shifted from conveying mechanism 21. For instance, blocking plate 12 may be hinged or include protrusions or other structures that interact with interior walls of housing 1*a* to permit blocking plate 12 the ability to shift down independent of conveying mechanism 21. Alternatively, the blocking plate 12 may engage with conveying mechanism 21 as opposed to engaging with the interior walls of housing 1*a*. Shifting blocking plate 12 separately from conveying mechanism 21 permits access to paper jams where sheet P (or parts of sheet P) has become lodged. Further, shifting blocking plate 12 as shown in FIG. 5B permits cleaning of dried ink and/or sheet powder from the upper surface 13 of blocking plate 12.

FIG. 5A shows the conveying mechanism 21 and other structures similar to FIG. 4A. FIG. 5A includes pivot 501 and pivot 502. Both are shown in FIG. 5A for explanatory purposes. In implementation, only one or none may actually be used. Pivot 501 represents a line about which blocking plate 12 pivots. Here, pivot 501 is located inward of the end of blocking plate 12. In an alternative example, pivot 502 represents a line about which blocking plate 12 pivots where pivot 502 is located at the end of blocking plate 12. It is appreciated that alternative pivot locations may be used (including pivot locations beyond the end of blocking plate 12) to allow for different pivoting functionality of blocking plate 12. For example, a pivot location beyond the end of blocking plate 12 may be realized by having separate extensions at the end of blocking plate 12 to allow blocking plate 12 to pivot about a line that does not intersect with blocking plate 12 itself.

FIG. 5A shows blocking plate 12 in the up position. FIG. 5B shows blocking plate 12 in the down position as having been pivoted down. For reference, blocking plate 12 is shown as 512*a* when pivoting through pivot 501 and is shown as 512*b* when pivoting through pivot 502.

When used to permit blocking plate 12 to pivot away from conveying mechanism 12, both pivots 501 and 502 provide a user with access to the area between blocking plate 12 and an underside of conveying mechanism 12.

Figure 6A:
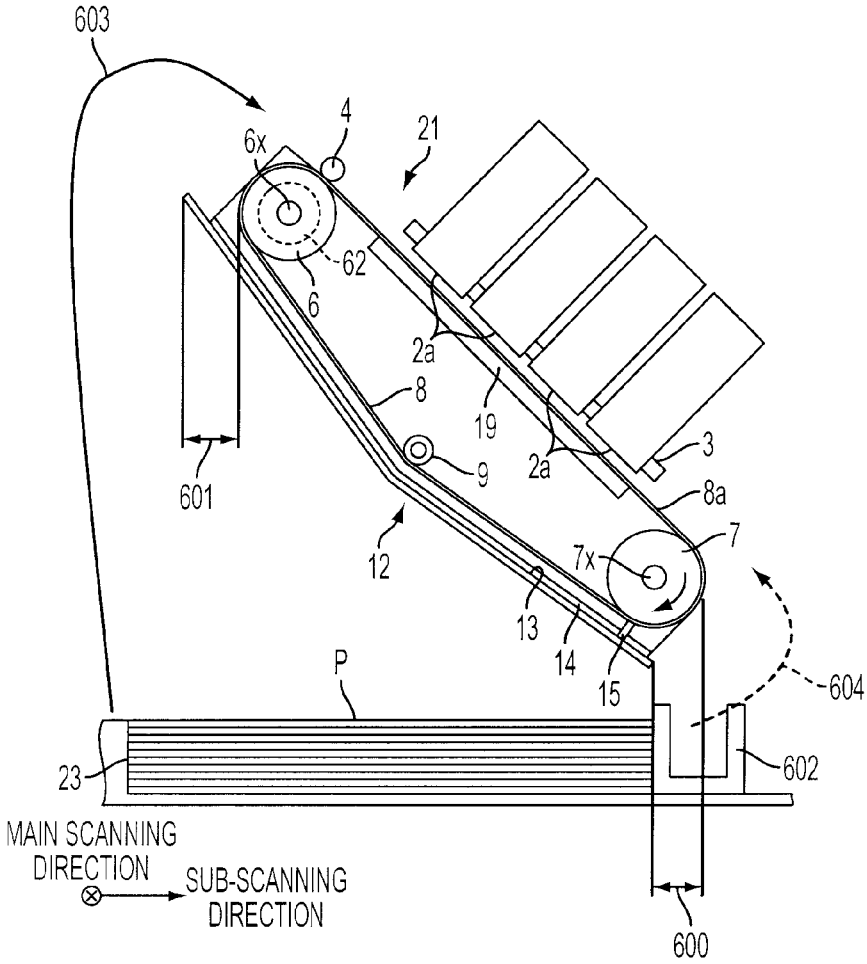
FIGS. 6A and 6B are illustrative diagrams of an image recording apparatus where the paper path is not horizontal.

FIG. 6A shows an embodiment in which conveying mechanism 21, inkjet heads 2, and frame 3 are tilted away from horizontal during normal operation of the recording apparatus. In this embodiment, the overall horizontal length of housing 1*a* may be decreased while the height of housing 1*a* increases based on the tilting of the conveying mechanism 21 and other structures described above. In one implementation, sheet P may be fed in the direction of solid arrow 603. In another implementation, sheet P may be fed in the direction of dashed arrow 604. FIG. 6A shows distance 601 relating to how far original blocking plate 12 extends beyond the end of belt roller 6 and/or conveying belt 8. Similarly, distance 600 relates to how far blocking plate 12 falls short of the end of roller 7 and/or conveying belt 8.

Blocking plate 12 may be shortened by the distance 601 as it extends beyond the vertical projection of the end of belt 8 and/or roller 6. Alternatively, blocking plate 12 may be kept extended to permit any sheet powder being conveyed by air currents to be trapped by blocking plate 12.

FIG. 6A shows blocking plate 12 being shorter than the length of the vertical projection of belt 8 and/or roller 7. Here, the stack of sheets P does not extend past blocking plate 12. Any sheet powder or ink from belt 8 is allowed to fall past blocking plate 12 without soiling sheets P in sheet tray 23. Belt 8 vertically overlaps a portion of sheet tray 23, and blocking plate 12 vertically overlaps that portion of sheet tray 23.

A container 602 for receiving sheet power or ink falling from belt 8 and blocking plate 12 may be disposed adjacent to sheet tray 23. The container 602 may extend so as to vertically overlap the lower end of blocking plate 12 and the end of belt 8 and/or roller 7.

Conveying mechanism 21 may pivot downward about shaft 7*x* of roller 7 together with blocking plate 12 such that blocking plate 12 enters a space above sheet tray 23.

Figure 6B:
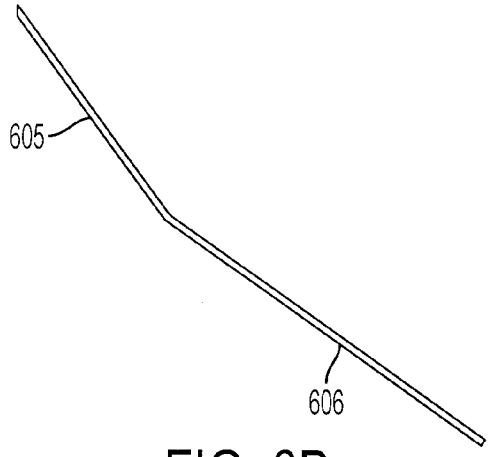

FIG. 6B shows an alternative arrangement in which blocking plate 12 is longer in one direction than the other. Section 605 is shorter than section 606 of blocking plate 12.

While the invention has been described in conjunction with a specific embodiment thereof, it is evident that many alternatives, modifications, and variations may be apparent to those skilled in the art.

Although, in the above-described embodiment, the user pulls out the sheet feed unit 1*b* from the housing 1*a* and then operates the rotary member 61 to shift the belt roller 6 for removing a jammed sheet, the shifting of the belt roller 6 may be performed automatically by a controller of the inkjet printer 1. For example, the printer 1 may include a sheet jam sensor for detecting a jam of the sheet P, a sheet feed unit sensor for detecting an attachment and a detachment of the sheet feed unit 1*b*, and a motor for driving the rotary member 61. In this case, when the sheet jam sensor detects a jam of the sheet P, the controller notifies the user of an occurrence of a sheet jam and instructs the user to pull out the sheet feed unit 1*b*. When the sheet feed unit sensor detects a detachment of the sheet feed unit 1*b* by the user, the controller causes the motor to shift the belt roller 6 into the space B of the sheet feed unit 1*b*. When the belt roller 6 is shifted, the controller instructs the user to remove a jammed sheet P. The user opens the door 1*d*, removes the jammed sheet P from the housing 1*a*, and closes the door 1*d*. In response to a detection of the removal of the jammed sheet P and the closing of the door 1*d*, the controller causes the motor to return the belt roller 6 to the original position. Then the controller instructs the user to attach the sheet feed unit 1*b* back to the housing 1*a*. When the sheet feed unit sensor detects an attachment of the sheet feed unit 1*b*, the printer 1 is made ready for printing. The attachment and detachment of the sheet feed unit 1*b* to and from the housing 1*a* may be performed by the controller and other appropriate mechanisms, without interaction of the user. The shifting of the belt roller 6 may be performed by various methods other than the above-described method. The belt roller 6 may be shifted without detaching the sheet feed unit 1*b* from the housing 1*a* and with a part of the sheet feed unit 1*b* remaining inside the housing 1*a*.

The roller shifting mechanism 60 may be configured by various components other than the rotary member 61, the ring 62, the link member 63, and the slit 64. Although, in the above-described embodiment, the driven belt roller 6 is shifted while the driving belt roller 7 remains stationary, the belt roller 7 may be shifted while the drive roller 6 remains stationary. Or, the belt rollers 6, 7 may be shifted simultaneously such that the conveying mechanism 21 is shifted parallel to itself In this case, the foreign substances received by the blocking plate 12 are less likely fall therefrom.

In the above-described embodiment, the feed roller 25, which is attached to the sheet feed unit 1*b*, is detached from the housing 1*a* when the sheet feed unit 1*b* is detached from the housing 1*a*. Alternatively, the feed roller 25 may be attached to the housing 1*a*. In this case, the feed roller 25 may be retracted from the space B before the sheet feed unit 1*b* is detached from the housing 1*a*. The position of the feed roller 25 may be changed as appropriate.

As an alternative to the above-described embodiment, the ink tank unit 1*c* as well as the sheet feed unit 1*b* may be detached from the housing 1*a*, and the belt roller 6 may be shifted into the space C. Or, the ink tank unit 1*c* may be omitted. Or, the sheet feed unit 1*b* may be shifted into spaces located below the conveying mechanism 21 and provided for storing an ink tank unit, a conveying mechanism for double-sided printing, or other units, instead of the space B for storing the sheet feed unit 1*b*.

As an alternative to the endless conveying belt 8 of the conveying mechanism 21, a rotating drum may be used to hold and convey the sheet P on an outer circumferential surface thereof, or a platen may be used to hold and convey the sheet P on a flat conveying surface thereof.

Although, in the above-described embodiment, the blocking plate 12 is made of stainless steel, the blocking plate 12 may be made of resin into a film-like shape or other shapes as long as it can receive foreign substances falling from the above. The blocking plate 12 may not include the blade 15, or may include a cleaning roller, instead of the blade 15.

A recording apparatus according to the invention is not limited to an inkjet printer and may be applied to a thermal printer, or is not limited to a line-type printer and may be applied to a serial-type printer with a reciprocating printhead, or is not limited to a printer and may be applied to a facsimile or a copying machine.

The preferred embodiments of the invention as set forth herein are intended to be illustrative, not limiting. Various changes may be made without departing from the spirit and scope of the invention as defined in the following claims.

What is claimed is:

1. A recording apparatus comprising:

a housing;

a conveying mechanism disposed in the housing and configured to convey a recording medium in a recording medium conveying direction, the conveying mechanism including a supporting member configured to support the recording medium;

a recording unit disposed in the housing and configured to record an image on the recording medium conveyed by the conveying mechanism;

a blocking member disposed below the conveying mechanism and vertically overlapping at least a part of the supporting member to receive foreign substances falling from the conveying mechanism; and an auxiliary unit located below the blocking member and configured to be attached to and detached from the housing;

wherein when the auxiliary unit is attached to the housing, the auxiliary unit occupies a first space, and wherein when at least a part of the auxiliary unit is detached from the housing, the auxiliary unit releases at least a second space included in the first space, such that, at least a part of the blocking member is allowed to move away from the conveying mechanism into the second space.

2. The recording apparatus according to claim 1, wherein a trapping member contacts the blocking member and is configured to trap the foreign substances.

3. The recording apparatus according to claim 2, wherein the trapping member is made of a porous material.

4. The recording apparatus according to claim 2, wherein the trapping member is made of an adhesive material.

5. The recording apparatus according to claim 2, wherein the trapping member includes two or more trapping members.

6. The recording apparatus according to claim 1, wherein the blocking member includes a removing member configured to remove the foreign substances from the supporting member and drop the foreign substances onto the blocking member.

7. The recording apparatus according to claim 1, wherein the housing includes a first pair of side walls opposed in the recording medium conveying direction, and wherein the blocking member extends beyond the supporting member in the recording medium conveying direction to positions adjacent to the pair of first opposed side walls of the housing.

8. The recording apparatus according to claim 7, wherein the blocking member vertically overlaps an entirety of the supporting member.

9. The recording apparatus according to claim 1, wherein the auxiliary unit includes a tray for storing therein the recording medium.

10. The recording apparatus according to claim 1, wherein the recording unit includes an inkjet head having ink ejecting nozzles that are opposed to the conveying mechanism.

11. The recording apparatus according to claim 1, wherein the conveying mechanism is pivoted about a pivot shaft at one end in the recording medium conveying direction, such that at least a part of an other end of the conveying mechanism is shifted into the second space.

12. The recording apparatus according to claim 1, wherein the conveying mechanism includes a pair of rollers arranged apart from each other in the recording medium conveying direction, and the supporting member comprises a belt that is wound around the pair of rollers so as to form a loop, and an outer circumferential surface of the belt is opposed to the recording unit at an upper portion of the loop and is opposed to the blocking plate at an lower portion of the loop.

13. The recording apparatus according to claim 1, wherein the blocking member includes two or more plates.

14. The recording apparatus according to claim 1, wherein the blocking member includes a single blocking plate.

15. A recording apparatus comprising:

a housing:

a conveying mechanism disposed in the housing and configured to convey a recording medium, wherein the conveying mechanism includes a supporting member for supporting the recording medium and is configured to move between a first position and a second position;

a recording unit disposed in the housing and configured to record an image on the recording medium; and a blocking member disposed below the conveying mechanism and vertically overlapping at least a part of the supporting member to receive foreign substances falling from the conveying mechanism, wherein the blocking member is configured to move between an upper position and a lower position, wherein the recording unit records an image on the recording medium when the conveying mechanism is in the first position and the blocking member is in the upper position, wherein when the conveying mechanism moves between the first position and the second position, the blocking member is configured to move integrally with the conveying mechanism, and wherein when the conveying mechanism is in the first position, the blocking member is configured to move, separately from the conveying mechanism, between the upper position and the lower position.

16. The recording apparatus according to claim 15, further comprising an auxiliary unit located below the blocking member and configured to be attached to and detached from the housing, wherein when the auxiliary unit is attached to the housing, the auxiliary unit occupies a first space, wherein when at least a part of the auxiliary unit is detached from the housing, the auxiliary unit releases at least a second space included in the first space, wherein at least a part of the conveying mechanism enters the second space when the conveying mechanism moves to the second position, and wherein at least a part of the blocking member enters the second space when the blocking member moves to the lower position.

17. A recording apparatus comprising:

a housing:

a conveying mechanism disposed in the housing and configured to convey a recording medium, wherein the conveying mechanism includes a supporting member for supporting the recording medium and is configured to pivot, about a first pivot axis, between a first position and a second position;

a recording unit disposed in the housing and configured to record an image on the recording medium; and a blocking member disposed below the conveying mechanism and vertically overlapping at least a part of the supporting member to receive foreign substances falling from the conveying mechanism, wherein the blocking member is configured to pivot, about a second pivot axis spaced apart from the first pivot axis, between an upper position and a lower position, wherein the recording unit records an image on the recording medium when the conveying mechanism is in the first position and the blocking member is in the upper position.

18. The recording apparatus according to claim 17, further comprising an auxiliary unit located below the blocking member and configured to be attached to and detached from the housing, wherein when the auxiliary unit is attached to the housing, the auxiliary unit occupies a first space, wherein when at least a part of the auxiliary unit is detached from the housing, the auxiliary unit releases at least a second space included in the first space, wherein a free end of the conveying mechanism enters the second space when the conveying mechanism pivots to the second position, and wherein a free end of the blocking member enters the second space when the blocking member pivots to the lower position.

* * * * *